United States Patent [19]

Brunelle et al.

[11] 3,976,880

[45] Aug. 24, 1976

[54] CORONA STABILIZATION ARRANGEMENT

[75] Inventors: Joseph A. Brunelle, West Webster; George J. Maszle, Ontario; Thomas J. Scudder, West Webster, all of N.Y.

[73] Assignee: Xerox Corporation, Stamford, Conn.

[22] Filed: Oct. 29, 1975

[21] Appl. No.: 626,677

[52] U.S. Cl. ..... 250/324; 250/325; 317/262 A

[51] Int. Cl.[2] ..... G03G 15/00; G03G 13/00

[58] Field of Search ..... 250/324, 325, 326; 317/262 A

[56] References Cited

UNITED STATES PATENTS 3,699,388 10/1972 Ukai ..... 250/324

3,800,154 3/1974 Tanaka ..... 250/326

*Primary Examiner*—Craig E. Church

[57] ABSTRACT

An arrangement for compensating for changes in the output of a corotron due to environmental changes. The arrangement includes a control corona device and a controlled corona device, the controlled corona device located in a xerographic reproduction machine in a position to deposit charge on an imaging surface and the control device located remote from said imaging surface and inoperative to deposit charge thereon, but exposed to the same environmental conditions of pressure and temperature, etc. The control corotron is connected in electrical parallel with the controlled corotron, which may be one or all of the corotrons used in the xerographic process, so that changes in the current flow in the control corotron due to the environment effect the voltage applied to the controlled corotron to produce a more stable output therefrom.

2 Claims, 3 Drawing Figures

FIG. 1
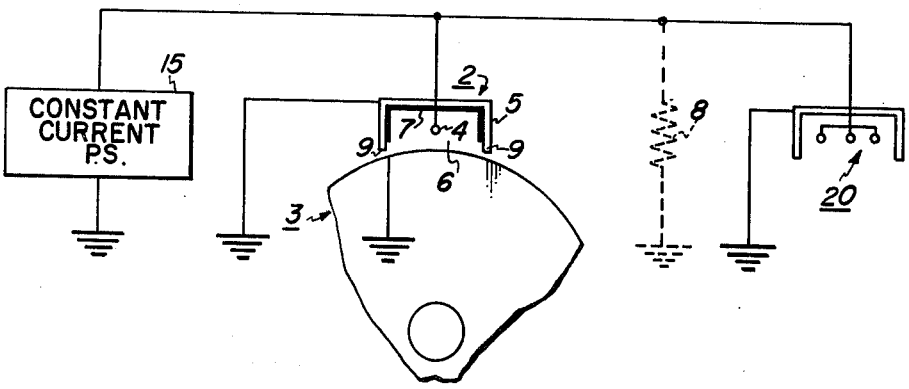
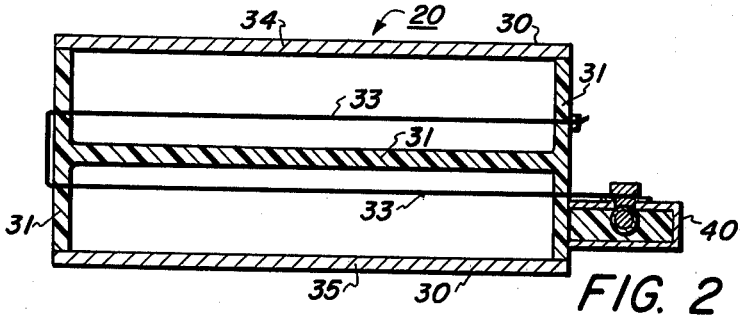
FIG. 2
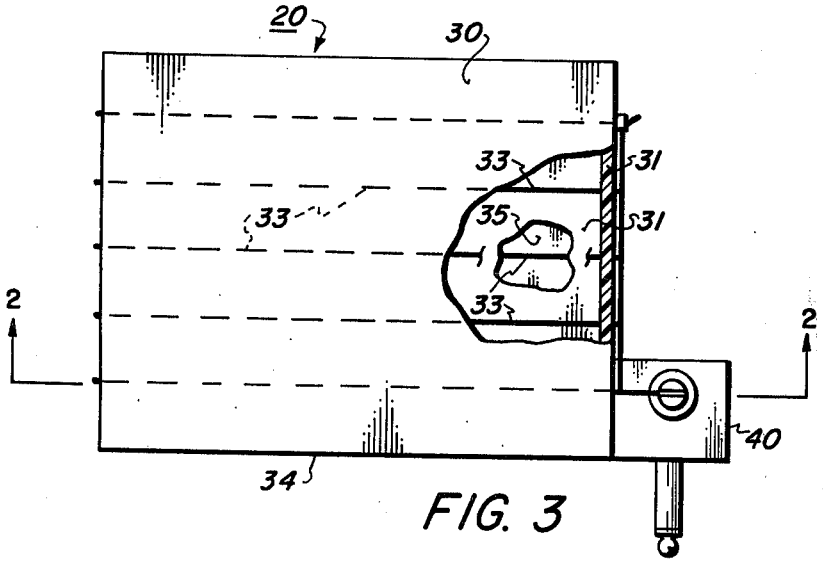
FIG. 3

CORONA STABILIZATION ARRANGEMENT

BACKGROUND OF THE INVENTION

This invention relates to xerography in general, and more particularly to corona devices used for charging and discharging imaging surfaces used in a xerographic process.

In xerography, uniform electrostatic charges deposited on the surface of a xerographic plate comprising a photoconductive insulating layer supported by conductive backing layer. Exposure to an optical image selectively dissipates the charge and the light struck areas, thus producing an electrostatic charge pattern in image configuration. An appropriate development process, such as dusting with an electroscopic powder which adheres to the charged areas, renders the latent image visible. This powder may then be transferred to a material such as paper by placing the material in face to face contact with the powder image and applying electrical charge to attract powder to the material surface. This copy may then be rendered permanent by fixing, such as by heat fusing.

In the above-noted electrographic process, electrostatic charging techniques are generally relied upon to accomplish such necessary processing steps as the transfer of an electrostatically formed image from a reusable photoreceptor structure to a transfer member and/or tacking and stripping operations associated with such transfer member.

While many forms of acceptable techniques for electrostatically charging a surface are known, corona discharge techniques have generally been preferred in applications such as those mentioned above because such techniques are particularly well suited to applying an electrostatic charge to a moving surface. In addition, the use of corona discharge techniques allows a selected surface to be rapidly charged to a relatively high potential. Conventional forms of corona generating apparatus are illustrated in U.S. Pat. Nos. 2,836,725 and 2,879,395 and generally comprise one or more wire-like electrodes, known as coronodes, horizontally disposed above the surface to be charged and a shield which may take a plurality of different structural forms, partially disposed about a coronode. In one conventional mode of operation, a high voltage d.c. power supply is connected to the coronode with the suitable polarity for the charging operation which is desired, while a conductive layer associated with the surface to be charged is grounded, as are the other terminal of the power supply and the shield.

In electrostatographic machines employing such corona devices, it is desirable to control the charge delivered within known limits. Thus to properly charge a moving xerographic imaging surface a specific rate of flow of charge to the imaging surface is required to obtain optimum copy quality. However, the output of such corona devices is effected by changes in the ambient conditions in which the device operates. Also, accumulations of toner, dust and chemical growths on the device alter its characteristics.

This invention is directed to an arrangement for compensating for the changes resulting from variations in the ambient conditions under which the corona discharge devices operate.

A control arrangement directed specifically to the problem of controlling the output of a corona device in response to changes in power supply voltage is shown in U.S. Pat. No. 3,122,634.

Another corona device control arrangement is shown in U.S. Pat. No. 3,244,683 in which two corona devices are connected across a common supply so that the amount of corona current leaving one corona device is equal and opposite to that entering the other corona device.

OBJECTS & SUMMARY OF THE INVENTION

It is, therefore, a primary object of the invention to improve the print quality from xerographic reproduction machines by reducing the affect of changes in ambient conditions on the corona charging devices of the machine.

This object and others are accomplished by an arrangement which includes a control corona device and a controlled corona device, the controlled corona device located in a xerographic reproduction machine in a position to deposit charge on an imaging surface and a control corona device connected in electrical parallel with the controlled device and located remote from said imaging surface to be inoperative to deposit charge thereon but being exposed to the same or similar ambient conditions of pressure and temperature, etc.

BRIEF DESCRIPTION OF THE DRAWINGS

FIG. 1 is an illustrative diagram of the overall arrangement of the invention;

FIG. 2 is an elevation view of the control corona device of the invention; and FIG. 3 is a plan view of the control corona device of the invention.

DESCRIPTION OF THE PREFERRED EMBODIMENT

Referring to FIG. 1, there is shown an illustrative diagram of the invention including a controlled corona discharge device 2 which is located adjacent an imaging surface 3 of a xerographic system. The details of the xerographic system including the imaging surface are well known and do not form a part of this invention. The corona discharge device 2 includes a wire electrode 4 and a conductive shield 5 generally U-shaped in cross-section which runs the length of the electrode 4 and surrounds it but for a charge emitting opening 6. The shield is grounded and may be coated on its interior surface with a dielectric coating 7. The coating 7 extends over substantially the entire interior surface except for the lips 9 which remain uncoated and exposed to the wire 4, as better illustrated in U.S. Pat. No. 3,471,695 and 3,794,839. The wire 4 is conventionally supported by insulating blocks (not shown) located at opposed ends of the shield 5. The corona device 2 is illustrated as being energized from a constant current power supply 15 which applies a corona generating voltage to the corona discharge electrode 4 of sufficient magnitude to generate a corona discharge about the wire, generally on the order of 3 KV to 8 KV and adjusts this voltage in response to changing output conditions to maintain the total output current delivered from the supply at a preselected value. The details of construction of such corona discharge devices are well known in the art, and specific information may be had by reference to U.S. Pat. Nos. 2,836,725 and 2,879,395, among others. A suitable constant current source is shown in U.S. Pat. No. 3,781,105.

The corona device 2 is operative to generate a flow of charge toward the imaging surface 3 to perform various functions in the xerographic process, as is well known in the art. The polarity of the charge may be positive or negative depending on the function to be performed by the charge in the xerographic process and the nature of the imaging surface. The constant current source 20 has been conventionally employed to compensate for changes in charge flow to the surface 3 resulting from various factors including changes in ambient conditions such as temperature and pressure, etc. The purpose of such a constant current source is to hold the current delivered by the device 2 to the imaging surface 3 constant despite such variations in ambient conditions.

In prior art systems, an electrical load represented in dotted lines by resistor 8 is sometimes connected in parallel with the controlled corona device 2. The resistor 8 is used to draw enough current to bring the total current delivered by the supply 15 up to a sufficiently high level for easier regulation. Thus, in the case where the type of corona device 2 being employed draws only a small and difficult-to-regulate current, the resistor 8 by providing an additional parallel current path increases the total supply current to a desirable level for easier regulation. In addition, the parallel load 8 usually is designed to carry a current several times higher than that drawn by the corona device itself, this being in part naturally from the low current drawn of corona devices of the type shown in FIG. 1.

In arrangements of the type shown in FIG. 1 using a resistor 8 an undesireable drift of the charging current supplied by the corona device 2 over charging ambient conditions has been noted. The reason for this is as follows: When ambient conditions change resulting in a smaller current drawn by the corona device 2, this condition is sensed as a decrease in total current by the supply which adjusts its terminal voltage to increase the total current to the previous preselected value. However, since only a smaller portion of the total current is being drawn by the corona device 2, a disproportionate amount of the current increase is directed to the load or resistor 8 rather than the corona device 2, thus resulting in poor regulation.

In order to compensate for changes in output caused by ambient conditions or to overcome the above noted problems associated with prior art arrangements, there is provided according to this invention a second or control corona device 20 in FIG. 1 connected in place of the prior art resistor 8 in parallel with the corona device 2. Referring to FIGS. 2 and 3, the compensating device 20 comprises a semi-closed aluminum outer housing 30 which is electrically grounded and an insulator support frame 31 which supports a plurality of corona wires 33 in the housing. The housing 30 comprises an upper plate 34 and a lower plate 35, both generally rectangular in shape. The plate 34 is spaced vertically above the plate 35 by means of a plastic frame 31 having a generally I-shaped cross section, the plates being held to the frame by any suitable fastening means (not shown). A corona wire is wound as shown in the drawings, between opposed spaced apart sections of the frame 31 and coupled to a voltage terminal block 40. The constant current source is connected to the terminal 40 as shown in FIG. 1. The control corona device 20 is located within the xerographic machine housing 10 remote from the imaging surface 3 and is thus inoperable to deposit charge thereon. Any suitable location for the purpose will suffice.

The wire electrode 33 may be made of any suitable conductive material such as platinum, tungstun or stainless steel having an appropriate diameter to generate a corona discharge when a high potential source is applied thereto.

The overall purpose of the physical construction of the corona device 20 is such that it will draw several times the current drawn by the corona device 2 when connected to the supply 15 as shown in FIG. 1. Thus, in operation the total current delivered by the constant current source will split into a first component current to the device 2 and a second component current to the device 20, the second current being several times larger than the first and typically comprising about 80% of the total current.

From a practical point of view, the control device 20 may be constructed to be of any suitable size so long as it fulfills the above object of drawing a majority of the current from the source 15.

If ambient conditions change to effect a decrease in current drawn by both corotrons, total current drops and this condition is sensed by the constant current power supply which adjusts the applied voltage upward until total current again reaches the preselected level. The increasing current is divided between the two corotrons based generally on the previous ratio of current drawn. As indicated, since the current through the sensor corona device is designated to comprise about 80% of the total, a similar percentage of the compensating current (caused by upward adjustment of the applied voltage) is directed to the sensor corotron. Thus, the initial ratio of currents in both the control and controlled corona devices is maintained generally constant over varying ambient conditions.

This may be contrasted with the operation of the prior art arrangement (with resistor 8 in place of corona device 20) in which the ratio of the currents drawn by the resistor 8 and the corona device 2 changes significantly with ambient conditions, as explained hereinbefore.

In summary, it is seen that the use of an additional control corona device connected in electrical parallel with a controlled corona device operates in combination with a constant current source to maintain the ratio of the current drawn by the controlled corona device to the total current supplied by a constant current source more uniform over changing ambient conditions. This is due essentially to the fact that the currents drawn by each corona device varies in the face of changing ambient conditions to a generally similar degree.

The controlled corona device, since it performs a xerographic function, is constructed having dimensions similar to that shown by the prior art as demanded by the particular xerographic system. The control corona device does not perform a function in the xerographic process and may therefore be smaller in size and unrelated to the imaging surface dimensions. Thus, a typical controlled corona device for use in the xerographic process would extend across the entire width of the imaging surface which is at least 8 inches. Contrasted to this, the width of the control corona device may be only one-half this size or smaller.

While the power supply 15 in FIG. 1 has been described as being of a direct current type, it is understood that an A.C. supply would also operate satisfactorily. For A.C. operation, the corona device 2 may be of a type shown in U.S. Pat. No. 3,742,237 and may be operated in a manner well known in the prior art.

While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. In combination, a housing, an electrostatic reproduction system including an imaging surface, located in said housing, a first corona discharge device located adjacent said surface for depositing charge on said imaging surface, said device including a first electrode and a first shield partially surrounding said electrode, a second corona discharge device located remote from said imaging surface and inoperative to deposit charge on said surface, said second device including a second corona discharge electrode and an adjacent conductive charge collecting shield, said first and second corona devices connected in electrical parallel with each other, and a constant current power supply for applying a corona energizing potential to said first and second electrodes.

2. The method of stabilizing the flow of charge from a first corona device to an imaging surface of a xerographic reproduction system produced by a high voltage constant current power supply comprising the steps of:

connecting a second corona device in electrical parallel with said first device, and locating said second device remote from said surface but subject to the same ambient conditions as said first device.

* * * * *